US006213266B1

(12) United States Patent
Hollingsworth

(10) Patent No.: US 6,213,266 B1
(45) Date of Patent: Apr. 10, 2001

(54) MODULAR LUGGAGE SYSTEM INCLUDING A WHEELED FLIGHT BAG AND AN EXTERNALLY DEMOUNTABLE, RELEASABLY ATTACHABLE COMPUTER CARRYING CASE

(75) Inventor: W. Dale Hollingsworth, Wilton, CT (US)

(73) Assignee: Targus Group International, New York, NY (US)

( * ) Notice: Subject to any disclaimer, the term of this patent is extended or adjusted under 35 U.S.C. 154(b) by 0 days.

(21) Appl. No.: 09/343,839

(22) Filed: Jun. 30, 1999

Related U.S. Application Data

(60) Provisional application No. 60/091,166, filed on Jun. 30, 1998.

(51) Int. Cl.[7] ..... A45C 3/00; A45C 13/00

(52) U.S. Cl. ..... 190/108; 190/102; 190/111; 150/111

(58) Field of Search ..... 190/102, 109, 190/110, 108, 111, 120; 150/111

(56) References Cited

U.S. PATENT DOCUMENTS

| | | | | |
|---|---|---|---|---|
| 1,084,360 | * | 1/1914 | Rahm | 190/108 |
| 3,319,744 | * | 5/1967 | Smith | 190/108 |
| 3,606,372 | * | 9/1971 | Browning | 190/108 X |
| 4,442,960 | * | 4/1984 | Vetter | 190/108 X |
| 4,693,345 | * | 9/1987 | Mittelmann | 190/108 |
| 4,817,789 | * | 4/1989 | Saliba | 190/120 X |
| 5,010,988 | * | 4/1991 | Brown | 190/104 |
| 5,217,119 | | 6/1993 | Hollingsworth . | |
| 5,253,739 | | 10/1993 | King . | |
| 5,267,679 | * | 12/1993 | Kamaya et al. | 190/108 X |
| 5,431,262 | * | 7/1995 | Rekuc et al. | 190/18 A |
| 5,472,084 | * | 12/1995 | Aliano, Jr. | 206/315.3 |

FOREIGN PATENT DOCUMENTS

| | | |
|---|---|---|
| 0 797939 A2 | 1/1997 | (EP) . |
| 0 797939 A3 | 1/1998 | (EP) . |

OTHER PUBLICATIONS

Targus Company, Shuttle by Targus, www.targus.com/products/cso2.htm.

(List continued on next page.)

*Primary Examiner*—Allan N. Shoap
*Assistant Examiner*—Tri M. Mai

(57) ABSTRACT

A modular luggage system includes wheeled flight bag with an externally demountable releasably attachable computer carrying case for carrying a delicate instrument such as a portable computer. The wheeled flight bag has wheels on a bottom wall and a retractable handle incorporated in an integral frame running up a back wall. The front of the flight bag includes a projecting member or salient tongue spaced a selected distance from a releasable fastening member. A computer carrying case adapted to be externally demountable from the flight bag has a bottom wall and a back wall including a receiving slot or aperture for receiving the salient tongue mounted on the flight bag. The computer carrying case also includes a releasable fastening member spaced such that when the computer carrying bag is mounted upon the flight bag, the salient tongue is received in the receiving aperture and the computer carrying case fastening member locks, buckles or otherwise fastens with the cooperating fastening member mounted on the top surface of the flight bag. Preferably, the computer carrying case includes a carrying handle spaced apart from the back edge of the top wall. In use, one may grasp the computer carrying case handle with the right hand and, with the thumb, depress a button or otherwise actuate the releasable fastening member, thereby releasing the fastening members from one another, such that the computer carrying case may be lifted and withdrawn away from the flight bag. The computer carrying case preferably includes a shock absorbing suspension or impact absorbing cushions for providing protection to the delicate instrument enclosed within.

18 Claims, 5 Drawing Sheets

U.S. PATENT DOCUMENTS 5,501,308 * 3/1996 King ..... 190/108 X
5,524,754 6/1996 Hollingsworth .
5,547,052 * 8/1996 Latshaw ..... 190/108
5,566,797 10/1996 Van Himbeeck .
5,593,009 1/1997 King .
5,622,262 4/1997 Sadow .
5,699,886 * 12/1997 Latshaw ..... 190/108
5,788,032 * 9/1998 Krulik ..... 190/108
5,810,230 * 9/1998 Nutto ..... 190/108 X
5,819,942 10/1998 Sadow .
5,842,673 * 12/1998 Fenton ..... 248/309.1
5,927,450 * 7/1999 Sadow ..... 190/102

* cited by examiner

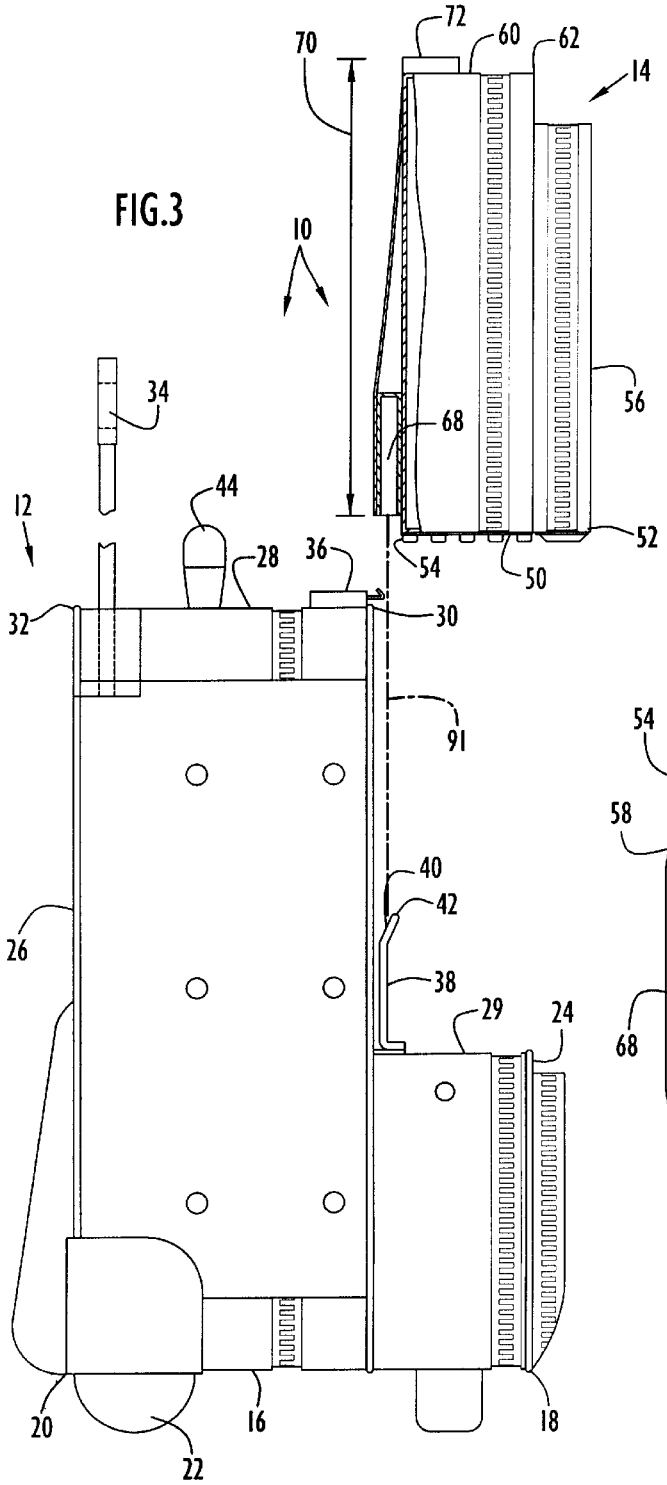
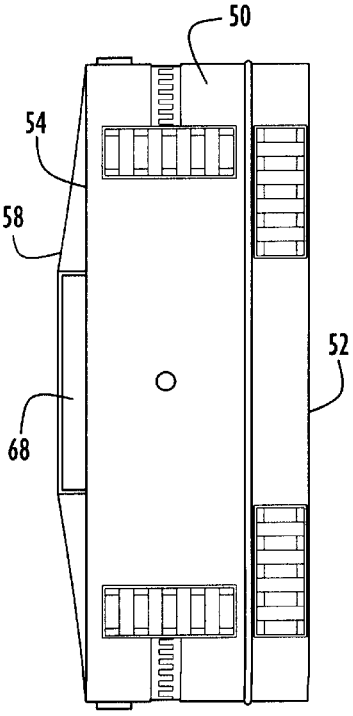
FIG.4

MODULAR LUGGAGE SYSTEM INCLUDING A WHEELED FLIGHT BAG AND AN EXTERNALLY DEMOUNTABLE, RELEASABLY ATTACHABLE COMPUTER CARRYING CASE

This application claims priority to U.S. provisional application No. 60/091,166, filed Jun. 30, 1998, the entire disclosure of which is incorporated herein by reference.

BACKGROUND OF THE INVENTION

1. Field of the Invention

The present invention relates generally to wheeled luggage cases, and more particularly, to a carry-on luggage case of the type known as a flight bag having wheels on a bottom wall of the case and a retractable handle for pulling the case along on the wheels. The flight bag includes an externally mounted, removable carrying case for securely transporting a delicate instrument such as a laptop computer.

2. Discussion of the Prior Art

"Flight bag" type luggage cases including wheels and a retractable handle for convenient storage in aircraft overhead storage bins are well known; see, e.g., U.S. Pat. No. 5,253,739 on a wheeled flight bag with a retractable pull handle and U.S. Pat. No. 5,566,797 on a wheeled integrated flight bag and garment bag luggage case, the entire disclosures of which are incorporated herein by reference.

Flight bags have enhanced the convenience of travel but the wheels and handle are only useful for transporting the flight bag itself and not the other articles a traveler may need to carry. As a result, many flight bag users have resorted to attaching second bags or other articles of luggage to a flight bag using rope, elastic cords (e.g. 'bungee' cords), tape and other temporary attachments which may not actually support and retain the second bag during the strenuous handling often encountered in commercial travel.

Luggage manufacturers have provided a more elegant solution to the problem faced by flight bag users wanting to carry a second bag by incorporating retractable luggage attaching straps, such as shown in U.S. Pat. No. 5,593,009. The retractable strap attachments can be attached to the second bag in any number of ways but do not securely bind the second bag to the flight bag; instead, the strap attachments merely provide a hook from which the second bag may hang, (e.g. by the second bag's handle). In addition, if a valuable article such as a portable computer is to be carried in the second bag, a retractable strap cannot be used to securely lock the second bag onto the flight bag.

Travelers often use "Laptop" and "Notebook" portable personal computers having reduced size and weight. Unfortunately, it is difficult to manufacture a compact portable computer which is rugged enough to withstand being dropped or otherwise subjected to shock loading. The small size of today's portable computers leaves little or no internal room for shock absorbing materials to protect the vulnerable operating parts of the computer such as the LCD screen, the hard drive, the mother board with its various electrical connectors or the plastic outer case.

The effect of being dropped or hit is measured in acceleration terms; one unit of gravitational acceleration (1 G) represents an acceleration (or deceleration) of 32 feet/sec$^2$. Each computer manufacturers design is unique, so there is no universally safe level of shock for portable computers. Computer hard drive manufacturers claim hard drives will typically withstand shocks in the range of 75 to 200 g.

Manufacturers of LCD screens, on the other hand, typically guarantee their screens to withstand shocks of only 50 g, a level reached by dropping a portable computer from a height of approximately six inches. Since carrying cases or luggage for portable computers are usually hand held, hung from shoulder straps or affixed to flight bags at heights substantially greater than six inches, cases designed to carry and protect computers must provide adequate protection against falls from these greater heights.

Most manufacturers of carrying cases for portable computers incorporate foam padding into their cases; the padding typically ranges in thickness from a half inch to three inches. Foam padding will protect a computer, unless the padding is compressed completely (e.g., compressed to half the original thickness). Thus, three inches of padding will protect the computer through a deceleration distance of only one and one-half inches. Tests have shown that in carrying cases provided with two inches of foam padding, the 50 G threshold (for LCD screens) is exceeded in drops from heights of as little as eight inches. Portable computer carrying cases offering superior protection against shocks are disclosed in U.S. Pat. No. 5,217,119, to W. Dale Hollingsworth (applicant in the present application), U.S. Pat. No. 5,524,754, to W. Dale Hollingsworth and patent application Ser. No. 09/235,292, filed Jan. 22, 1999, also to W. Dale Hollingsworth; the entire disclosures of U.S. Pat. Nos. 5,217,119, 5,524,754 and patent application Ser. No. 09/235,292 are incorporated herein, in their entireties, by reference.

If a traveler carrying a flight bag also has a portable computer carried in a second bag, bungee cords, retractable straps and tape cannot be relied on to securely attach the second bag to the flight bag since, as discussed above, the resulting combination is not well suited to rough handling, even if the second bag is the finest computer carrying case.

Others have offered a somewhat better solution to the problems confronting traveling computer users, at least insofar as attaching the computer carrying case is concerned. The Targus company offers a flight bag called the "Targus Shuttle" in which a computer case is carried entirely within a flight bag compartment and accessed by opening a zip-down flap opening into the flight bag compartment. A traveling computer user must open the flight bag zip-down flap and remove the computer carrying case from within the compartment in the flight bag, then close the flight bag zip-down flap for flight bag stowage; a sequence of steps requiring the traveler to set the computer carrying case aside somewhere while closing the flight bag zip-down flap.

Often, a computer user traveling with a portable computer on an airplane is confronted by conflicting needs. When boarding and before take-off, the computer user must quickly stow any carry-on luggage in an available overhead compartment, hanging closet or under-seat space. The airplanes aisles are often narrow, cramped and crowded with other impatient travelers who are struggling to fill the rapidly diminishing overhead compartments with their own carry-on luggage or hurrying to find and occupy their seats. Often, a computer user wants to use his or her portable computer during the flight. Problems arise if the computer user has packed the portable computer in a flight bag which must now be quickly stowed in the overhead compartment before all available space is depleted by others, or before other travelers trying to reach their seats lose patience. If the computer user stands in the aisle, opens the flight bag, removes the portable computer and then closes the flight bag, tempers may flare. The only other choice is to quickly stow the flight bag and later try to retrieve the flight bag from a packed overhead compartment to unpack the computer while en-route.

There is a need, then, for a luggage system that confers the benefits of a flight bag but does not penalize the computer user who needs a protective computer carrying case and ready, convenient access to the computer.

OBJECTS AND SUMMARY OF THE INVENTION

Accordingly, it is a primary object of the present invention to confer the easy carry benefits of a flight bag without penalizing the computer user needing a protective computer carrying case and ready, convenient access to the computer.

Another object of the present invention is to securely affix an auxiliary luggage module (e.g., a computer carrying case) to a to a main luggage module (e.g., a flight bag) in a lockable, externally demountable, releasably attachable coupling.

Another object of the present invention is to provide a method and apparatus for rapidly, conveniently releasing an externally mounted auxiliary luggage module or case from a main luggage module, using one hand.

The aforesaid objects are achieved individually and in combination, and it is not intended that the present invention be construed as requiring two or more of the objects to be combined unless expressly required by the claims attached hereto.

In accordance with the present invention, a modular luggage system includes a wheeled flight bag carrying an externally demountable, releasably attachable computer carrying case for carrying a delicate instrument such as a portable computer. The wheeled flight bag has wheels on a bottom wall and a retractable handle incorporated in an integral frame running up a back wall. The front of the flight bag includes a substantially vertical projecting member or salient tongue spaced a selected distance of approximately twelve inches from a first releasable fastening member (e.g., a latch member, buckle, lock or the like). A computer carrying case adapted to be externally demountable from the flight bag has an exterior wall including a substantially vertical receiving slot or aperture for receiving the salient tongue mounted on the flight bag. The computer carrying case includes a second releasable fastening member (spaced from the slot at the selected distance, e.g., twelve inches), and is releasably fastened to the flight bag when mounted upon the flight bag with the flight bag salient tongue received in the computer carrying case receiving aperture. When mounted, the computer carrying case second fastening member is locked or otherwise fastened with the cooperating first fastening member mounted on the top surface of the flight bag, thus preventing the necessarily vertical removal of the computer carrying case from the flight bag.

Preferably, the computer carrying case includes a carrying handle on a top wall, spaced from the top wall back edge. Similarly, the flight bag includes a suitcase style carrying handle on a top wall, spaced from the first releasable fastening member. When the computer carrying case is mounted on the flight bag, the first and second cooperating releasable fastening members of the flight bag and computer carrying case are positioned between the flight bag carrying handle and the computer carrying case handle.

In use, one may mount the computer carrying case by grasping the computer carrying case by the handle with the right hand and lowering the computer carrying case receiving aperture onto the substantially vertical salient tongue of the flight bag, thereby positioning the computer carrying case fastening member adjacent the cooperating fastening member on the flight bag. One may then, with one hand, move the computer carrying case handle horizontally to engage the cooperating fastening members, thereby securing the computer carrying case to the flight bag. When it is desired to remove the computer carrying case from the flight bag, one hand is needed to grasp the computer carrying case handle and, with the thumb, one may depress a button or otherwise actuate the carrying case fastening member, thereby releasing the cooperating fastening members from one another such that the computer carrying case may be lifted and withdrawn vertically away from the flight bag.

The computer carrying case preferably includes a shock absorbing suspension or impact absorbing cushions providing protection for the delicate instrument (e.g., laptop computer) enclosed within.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

BRIEF DESCRIPTION OF THE DRAWINGS

FIG. 3 is an exploded side view, in elevation, of the modular luggage system of FIG. 1, in accordance with the present invention.

FIG. 4 is a bottom plan view of the computer carrying case of FIGS. 1–3, in accordance with the present invention.

DESCRIPTION OF THE PREFERRED EMBODIMENT

Figure 1:
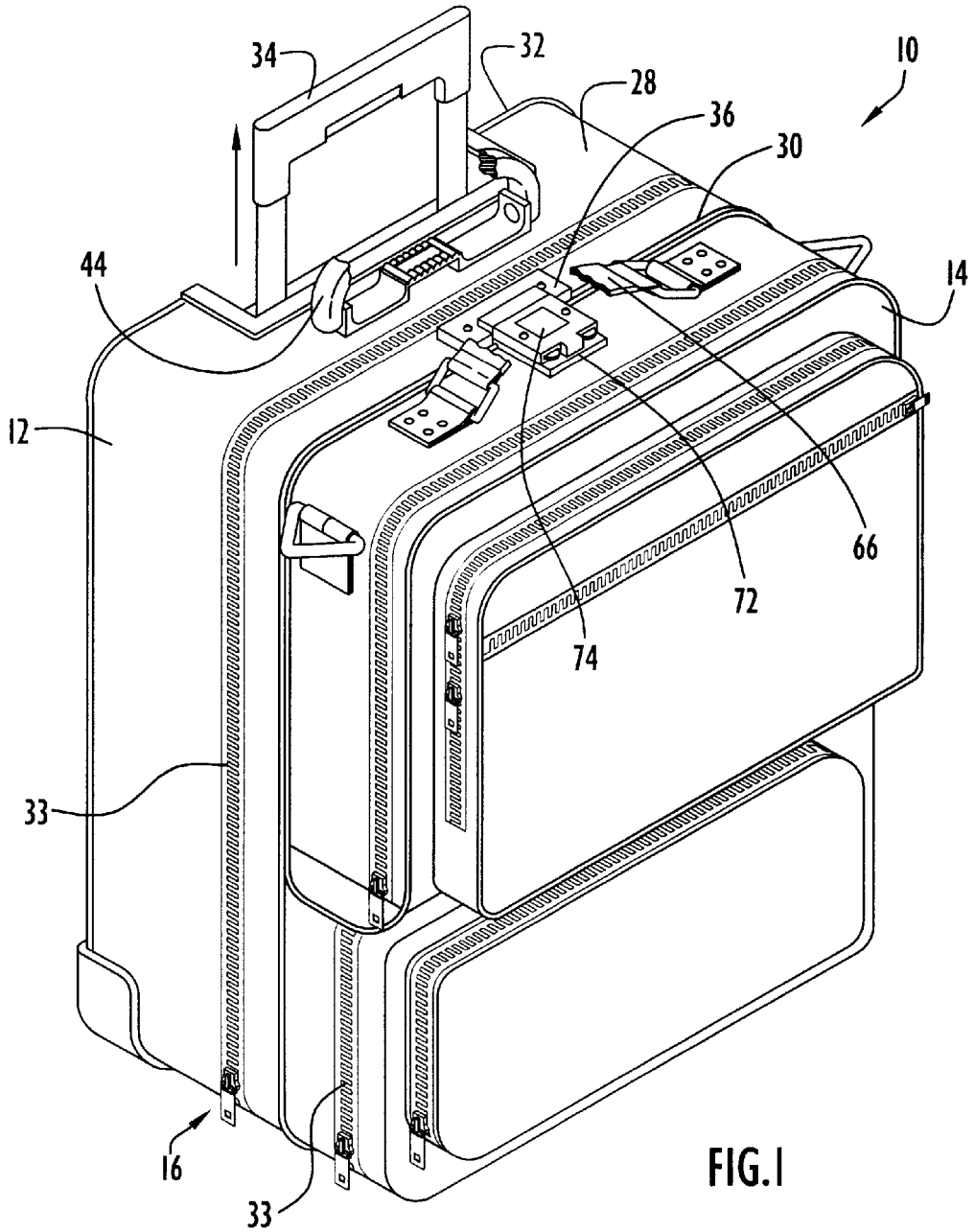
FIG. 1 is a perspective view, in elevation, of a modular luggage system including a wheeled flight bag and an externally demountable, releasably attachable computer carrying case, in accordance with the present invention.
Figure 2:
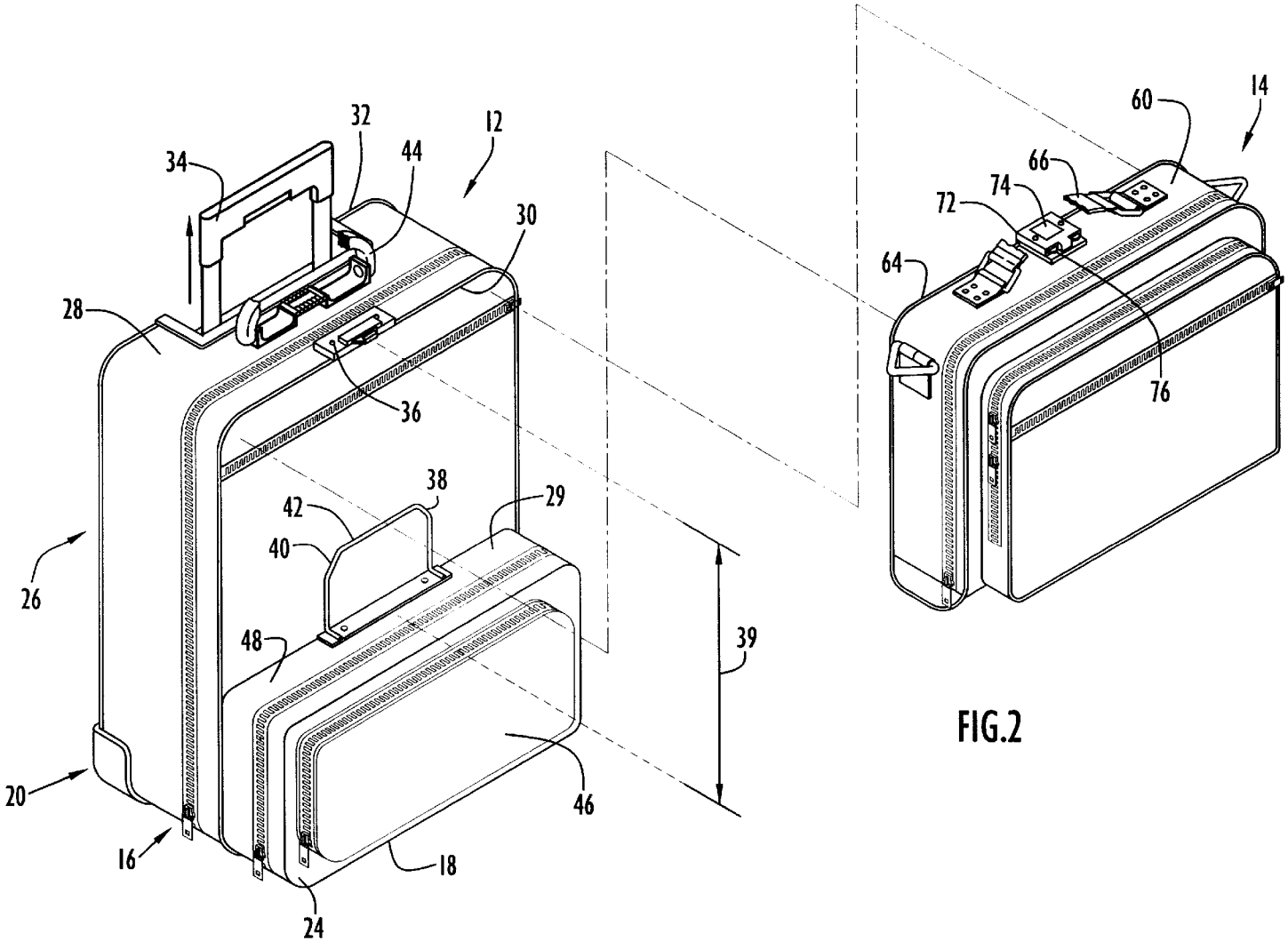
FIG. 2 is an exploded perspective view, in elevation, of the modular luggage system of FIG. 1, in accordance with the present invention.

Referring specifically to FIGS. 1, 2 and 3 of the accompanying drawings, a modular luggage system 10 includes a main luggage case or flight bag 12 and an externally mounted auxiliary luggage case or computer carrying case 14. As best seen in FIGS. 2 and 3, flight bag 12 includes an elongate, substantially planar, rectangular bottom wall 16 having a front edge 18 parallel to an opposing back edge 20. Flight bag bottom wall 16 includes at least one and preferably two rollers or wheels 22 recessed therein and carried on freely spinning axles or bearings. Wheels 22 are preferably located along flight bag bottom wall back edge 20 near the corners formed along opposing ends of back edge 20, thereby providing a wide stance and enhanced stability.

Flight bag bottom wall 16 is contiguously connected with substantially planar and perpendicular lower front wall 24 which opposes and is parallel to substantially planar, perpendicular back wall 26, the lower front wall extending upwardly from the bottom wall 16 to a top edge 31. Flight bag back wall 26 is terminated in the substantially planar top wall 28 which is spaced from and substantially parallel to bottom wall 16. Top wall 28 is contiguously connected with substantially planar and perpendicular upper front wall 27 which opposes and is parallel to back wall 26, the upper front wall extending downwardly from the top wall 28. An upper surface or wall 48 extends substantially perpendicularly between the upper and lower front walls and connects the upper front wall 27 with the top edge 31 of the lower front wall 24.

As can be seen from careful inspection of FIGS. 2 and 3, flight bag bottom wall 16 extends frontwardly or forwardly beyond top wall front edge 30 and has a frontwardly projecting storage compartment 46 between bottom wall 16 and upper surface 48. A substantially vertical salient tongue 38 is mounted on upper surface 48 and projects upwardly therefrom in a first plane parallel with the axes of front wall 24 and back wall 26. The tongue 38 is spaced a small distance forwardly of the upper front wall 27 and is parallel thereto. Flight bag top wall front edge 30 opposes a top wall back edge 32 which is interrupted by a recessed, flanged pocket receiving the flight bag retractable, elongate handle 34. Top wall 28 also includes a first releasable fastening member 36 such as a latch, hasp or buckle proximate front edge 30, preferably in the center of the front edge, as best seen in FIGS. 1 and 2.

Flight bag exterior 29 comprises the flight bag exterior walls 16, 24, 26, 27, 28 and 48 and includes all of the surfaces enveloping and enclosing a flight bag interior volume divided into, preferably, a plurality of compartments separately accessible for storage. Access is gained to the flight bag interior volume using any of the several zipper fasteners 33 carried in the exterior walls.

Flight bag exterior 29 includes the upper surface 48 upon which is mounted the salient tongue or projecting pin member 38 which is spaced a selected distance 39 from the flight bag releasable fastening member 36, as best seen in FIG. 2. In the exemplary embodiment of FIGS. 1–3, salient tongue 38 is a substantially vertical, rigid loop of bent metal wire and preferably defines a forwardly angled guiding surface 40 proximate the distal end 42, as best seen in FIG. 3.

A padded, rotatable handle 44 (shown partly cut-away in FIGS. 1 and 2) is affixed by hinges or pins to flight bag top wall 28. As noted above, retractable, elongate carrying handle 34 is also preferably recessed in flight bag top wall 28; flight bag 28 is therefore adapted to be grasped by the retractable and extendable handle 34 and pulled along on wheels 22 or carried by rotatable handle 44.

As shown in FIGS. 2, 3 and 4, auxiliary luggage case or computer carrying case 14 includes an elongate and substantially planar bottom wall 50 terminated in a front edge 52 opposing a back edge 54. Computer carrying case front wall 56 extends upwardly from and perpendicularly to bottom wall 50 and opposes computer carrying case back wall 58 which terminates in elongate and substantially planar top wall 60 having a front edge 62 opposing a substantially parallel back edge 64. A pair of side walls 65 extend between the bottom and top walls 50 and 60 and between the front and back walls 56 and 58. Computer carrying case 14 has a carrying handle 66 (shown partly cut-away in FIGS. 1, 2 and 7) mounted substantially in the middle of top wall 60. A receiving aperture, slot or blind hole 68 is disposed within and carried by the computer carrying case on exterior surface, preferably on back wall 58 or bottom wall 50. As shown in FIGS. 3 and 4, the aperture 68 is disposed between back wall 58 and a back panel 59 disposed exteriorly over back wall 58. Receiving aperture 68 is preferably formed as an elongate open ended box or pocket (shown in cross section in FIG. 3) having a vertical major axis substantially parallel to computer carrying case back wall 58 and computer carrying case front wall 56. Receiving aperture 68 has a downward facing opening dimensioned to receive salient tongue 38 of flight bag 12; the opening of the receiving aperture 68 is spaced a selected distance 70 (e.g., twelve inches, as shown in FIG. 3) from a second releasable fastening member 72 mounted upon computer carrying case top wall 60 proximate the back edge 64, approximately in the middle of the top wall back edge 64. The back panel 59 extends angularly outwardly in a rearward direction from the back edge 64 of top wall 60 to a lower edge 69 spaced from the back wall 58 so as to accommodate the aperture 68, the opening to which is disposed near the back edge 54 of bottom wall 50.

Computer carrying case receiving aperture 68, as best seen in FIGS. 3 and 4, is preferably a five sided reinforced box having a rectangular slot opening facing the computer carrying case bottom wall 50. The rectangular slot opening of aperture 68 has a long dimension of approximately six inches and a short dimension of approximately seven-sixteenths inches and so is dimensioned to receive flight bag salient tongue 38 which projects upwardly from flight bag exterior surface 29 to a height of approximately three inches with a maximum width of five and seven-eighths inches.

Figure 5:
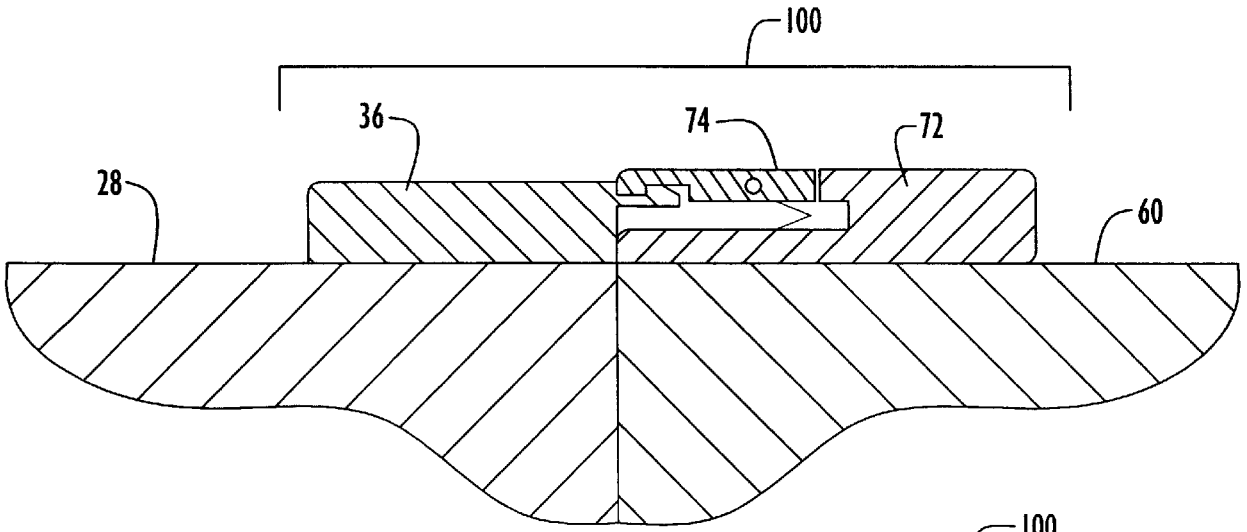
FIG. 5 is a schematic illustration, in partial cross section, of the cooperative fastening members of the modular luggage system of FIG. 1, in the closed state, in accordance with the present invention.
Figure 6:
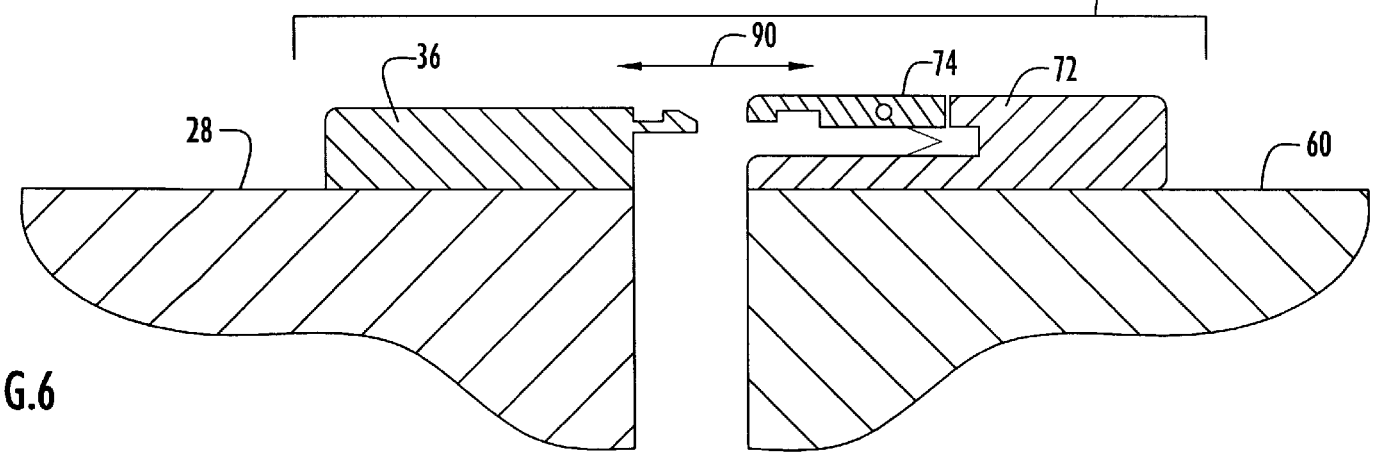
FIG. 6 is a schematic illustration, in partial cross section, of the cooperative fastening members of the modular luggage system of FIG. 5, in the open state, in accordance with the present invention.

On the top surfaces, the flight bag first releasable fastening member 36 and cooperating computer carrying case second releasable fastening member 72 form two halves of a releasable fastener 100 (e.g., a latch, buckle or clasp) preferably actuated (e.g., released) by depressing a button 74 and moving the two fastener halves apart horizontally. FIG. 5 is a schematic illustration, in partial cross section, of the fastener 100 including cooperative fastening members 36, 72 of the modular luggage system of FIG. 1, in the closed state; FIG. 6 is a schematic illustration, in partial cross section, of the fastener 100 including cooperative fastening members of the modular luggage system of FIG. 5, in the open state. Fastener 100 is opened and closed along a line of operation 90 lying in a horizontal plane substantially parallel to the flight bag top wall 28 and the computer carrying case top wall 60; the line of operation 90 is therefore substantially transverse to the major axis of the computer carrying case receiving aperture 68 and salient tongue 38 which, as noted above, projects upwardly in a first substantially vertical plane parallel with the axes of the front wall 24 and the back wall 26. The line of operation 91 (as seen in FIG. 3) of the salient tongue 38 and receiving aperture 68 is transverse to the line of operation 90 of the fastener 100, which, when fastened, prevents the vertical removal of the computer carrying case or auxiliary bag 14 from the flight bag or main luggage case 12.

In the preferred embodiment as shown in FIGS. 1 and 2, computer carrying case second releasable fastening member 72 includes a combination lock operable by first and second combination lock number wheels 76. The user may grasp the computer carrying case 14 by handle 66 and lower the computer carrying case onto the flight bag, whereupon salient tongue 38 is received in computer carrying case receiving aperture 68. Preferably, the computer carrying case bottom wall 50 is then resting upon the upward facing surface 48 of the flight bag projecting compartment 46 which defines an abutment surface as part of the exterior surface 29 of flight bag 12. The first and second fastening members 36 and 72 of fastener 100 may then be brought together and fastened as shown in FIGS. 1 and 5, thereby latching or fastening the computer carrying case 14 onto flight bag 12, whereupon computer carrying case 14 is secured to flight bag 12 by two fixed attachment points; the first fixed attachment point is the fastener 100, the second fixed attachment point includes salient tongue 38 retained within receiving aperture 68.

The first and second fixed attachment points are separated by the selected distance of approximately twelve inches (e.g., distance 39 as shown in FIG. 2 and distance 70 as shown in FIG. 3), and so form a two-point coupling that is difficult to twist or torque in attempting to forcibly remove flight bag 12. Since the releasable fasteners and tongue and groove provide two attachment points separated by the selected distance (e.g. twelve inches) it is virtually impossible to torque, twist or pry computer carrying case 14 apart from flight bag 12. By locking the combination lock included in fastening member 72, the computer carrying case is securely attached to flight bag 12 and is therefore much less likely to be stolen or removed by mistake.

Figure 7:
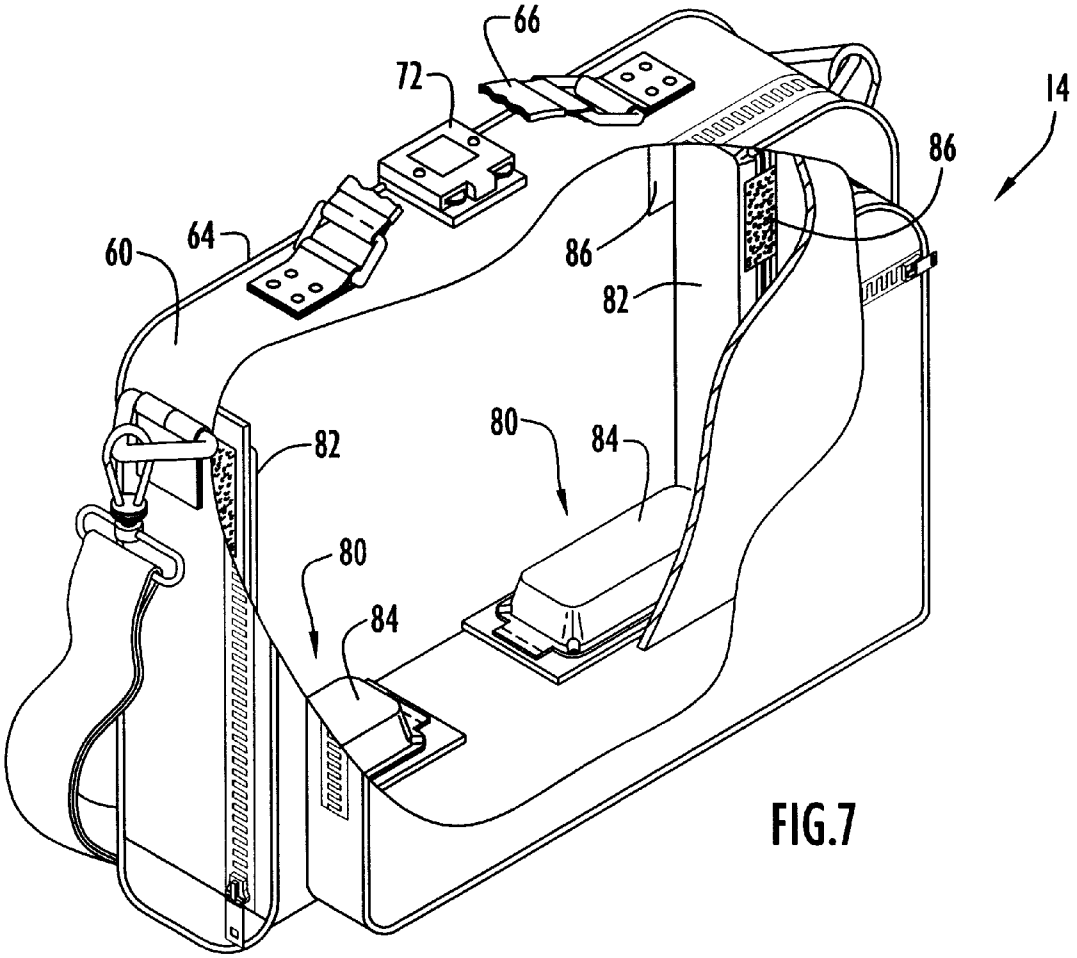
FIG. 7 is a perspective, partially cut-away view of the computer carrying case of FIG. 4, in accordance with the present invention.

Turning now to the equipment protection features of computer carrying case 14, FIG. 7 is a perspective, partially cut-away view of computer carrying case 14 including a plurality of adjustable, impact resistant cushions 80 with first and second pads 82, 84, each including a compressible, substantially rectangular foam piece covered with a pliable non-porous cover. The cover contiguously envelops the foam piece and includes an air flow controlling vent. Air escapes from the pad through the vent at a controlled rate when the foam material is compressed; the pad absorbs shock by providing resistance to compression. The resistance to flow of escaping air increases with increasing compression velocity. Preferably, open cell urethane foam is employed in the compressible foam piece. The adjustable impact resistant cushion second pad 84 preferably has a greater thickness than that of the first pad 82. The first and second pads 82, 84 are hingedly connected to one another by a flexible hinge segment of webbing or plastic. Each adjustable cushion 80 includes, on a back surface, one or more releasable hook and loop type fastener elements (e.g., either hooks or loops).

Preferably, two of the impact resistant cushions 80 are used in a luggage insert (for insertion into a carrying case or other luggage) or are incorporated directly into the interior portion of carrying case 14 in a compartment with an interior surface covered with felt or loop material for attachment using hook fastener arrays carried by the adjustable cushions. An adjustable cushion may also carry one or more flexible tabs 86 extending outwardly from the cushion pad major axis and so can be positioned in cushion pairs at selected separations and angular orientations, thereby accommodating portable computers (or other delicate instruments) having different widths and shapes.

A removable luggage insert in accordance with the present invention (not shown) may be carried in carrying case 14 providing impact resistant support for a portable computer or another delicate instrument and includes a container or receptacle portion having a compartment interior surface of felt or loop fastener elements. Preferably, the insert is shaped substantially as a six-sided box having a front wall opposing a back wall, a top wall opposing a bottom wall, and a left side wall opposing a right side wall. In the simplest embodiment, one pair of opposing walls (on the interior of case 14 or an insert compartment) carries fastener elements for receiving the hooks on the adjustable impact-resistant cushions 80. Each impact resistant cushion preferably includes a hinge segment and is placed with a first pad on a compartment side wall, for example, and a second pad on the bottom wall of the compartment. The second impact resistant cushion is placed with a first pad on the compartment side wall opposing the side wall having the first impact resistant cushion and has the second pad positioned substantially at a right angle thereto, on the bottom wall, substantially in line with the second pad of the first adjustable impact resistant cushion. The compartment has a lineal dimension (e.g., along the bottom wall) greater than the combined dimensions of the second pads of the first and second cushions. Using the hook fasteners on the flexible tabs 86 carried by (at least one on the adjustable impact resistant cushion, it is possible to position the cushion with a first pad spaced apart from the side wall of the compartment while the second pad rests on the bottom wall, thereby accommodating a portable computer having a narrower outer case or housing. The carrying case 14 can accommodate the adjustable cushions 80 in a plurality of positions or angular orientations, thereby accommodating irregularly shaped delicate instruments or computers.

When using modular luggage system 10, removal of computer carrying case 14 requires only one hand; the user grasps computer carrying case handle 66 and, using a thumb or finger, depresses fastening member button 74, thereby releasing fastener 100 and disconnecting the flight bag fastening member 36 from the computer carrying case fastening member 72 and allowing the user to horizontally or laterally translate the fastening members apart along the line of operation 90 (as shown in FIG. 6), whereupon computer carrying case 14 is lifted vertically away, withdrawing salient tongue 78 from receiving aperture 68. The user then has the computer carrying case in one hand and the other is hand free to move flight bag 12, as may be required to stow flight bag 12 in a standing closet, overhead compartment or the like.

A user re-mounts or re-attaches the computer carrying case 14 by grasping the computer carrying case handle 66 (e.g., with the right hand) and vertically lowering case 14 onto salient tongue 38 of flight bag 12 and against the flight bag abutment surface, thereby positioning the computer carrying case second releasable fastening member 72 adjacent the cooperating fastening member 36 on flight bag 12. The user can then place one hand on computer carrying case handle 66, and move the cooperating fastening members 36, 72 horizontally or laterally toward one another along line of operation 90 to engage and fasten the cooperating fastener members 36, 72 to one another, thereby securing fastener 100 and externally attaching or mounting the computer carrying case 14 to the flight bag 12.

It will be appreciated that the present invention makes available a modular luggage system including a main luggage case or flight bag 12 preferably including a pull handle 34, carrying a salient tongue or pin 38 and also carrying a first releasable fastening member 36 positioned a selected distance 39 from salient tongue 38, and an externally demountable, releasably attachable auxiliary luggage case or computer carrying case 14 including a receiving aperture 68 dimensioned to receive the main luggage case salient tongue 38; where the auxiliary luggage case 14 carries a second releasable fastening member 72 positioned to be fastenable with the main luggage case first releasable fastening member 36 when the main luggage case salient tongue 38 is received within the auxiliary case receiving aperture 68. The terms "flight bag" and "computer carrying case" are, therefore, merely exemplary terms describing a preferred embodiment of the present invention.

In as much as the present invention is subject to various modifications and changes in detail, the above description of a preferred embodiment is intended to be exemplary only and not limiting. It is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A modular luggage system, comprising:

a main luggage case having a top wall, a pair of side walls, a bottom wall carrying a wheel, a back wall, an upper front wall extending downwardly from said top wall, a lower front wall extending upwardly from said bottom wall to a top edge and an upper surface extending substantially perpendicularly between said upper front wall and said top edge; said main luggage case including a pull handle and carrying a salient tongue extending upwardly from said upper surface; said main luggage case also carrying a first releasable fastening member positioned a selected distance from said salient tongue;

an externally demountable, releasably attachable auxiliary luggage case having a top wall, a pair of side walls, a bottom wall, a back wall and a front wall, said auxiliary luggage case including a back panel disposed exteriorly over said back wall of said auxiliary luggage case and a receiving aperture disposed between said back panel and said back wall of said auxiliary luggage case, said back panel having an upper edge connected to said top wall of said auxiliary luggage case and a lower edge spaced from said back wall of said auxiliary luggage case to accommodate said receiving aperture therebetween, said receiving aperture being dimensioned to receive said main luggage case salient tongue; said auxiliary luggage case carrying a second releasable fastening member positioned to be fastenable with said main luggage case first releasable fastening member when said main luggage case salient tongue is received within said receiving aperture.

2. The modular luggage system of claim 1, wherein said main luggage case salient tongue includes a distal end and a guiding surface proximate said distal end.

3. The modular luggage system of claim 1, wherein said auxiliary case is a computer carrying case having an enclosed volume sized to receive a portable computer and including a shock-absorbing member.

4. A carrying case for carrying a portable computer or other delicate instrument, comprising:

a substantially planar elongated bottom wall having a front edge opposing a back edge;

front and back walls extending upwardly from said front and back edges of said bottom wall;

an elongated top wall having a front edge connected to said front wall and a back edge connected to said back wall;

a pair of side walls extending between said front and back walls and between said bottom and top walls;

a back panel disposed exteriorly over said back wall, said back panel extending angularly downwardly from said back edge of said top wall to a lower edge spaced from said back wall;

a receiving aperture disposed between said back panel and said back wall, said receiving aperture being positioned a selected distance from said top wall;

said top wall carrying a releasable fastening member proximate said back edge; and said walls defining an enclosed volume sized to receive the portable computer or other delicate instrument and including a shock-absorbing member.

5. A carrying case for carrying a portable computer or other delicate instrument, comprising:

a substantially planar elongated bottom wall having a front edge opposing a back edge;

front and back walls extending upwardly from said front and back edges of said bottom wall;

an elongated top wall having a front edge opposing a back edge juxtaposed with said back side wall;

a back panel disposed exteriorly over said back wall and having an upper edge connected to said top wall and a lower edge spaced from said back wall;

a receiving aperture between said backwall and said lower edge of said back panel, said receiving aperture being positioned a selected distance from said top wall;

said top wall carrying a releasable fastening member proximate said back edge; and said walls defining an enclosed volume sized to receive the portable computer or other delicate instrument and including a shock-absorbing member, said shock absorbing member including an impact-absorbing cushion.

6. A carrying case for carrying a portable computer or other delicate instrument, comprising:

a substantially planar elongated bottom wall having a front edge opposing a back edge;

front and back walls extending upwardly from said front and back edges of said bottom wall;

an elongated top wall having a front edge opposing a back edge juxtaposed with said back side wall;

a back panel disposed exteriorly over said back wall at an angle to said back wall and having a lower edge spaced from said back wall;

a receiving aperture between said back wall and said lower edge of said back panel, said receiving aperture being positioned a selected distance from said top wall, said selected distance from said top wall being approximately twelve inches;

said top wall carrying a releasable fastening member proximate said back edge; and said walls defining an enclosed volume sized to receive the portable computer or other delicate instrument and including a shock-absorbing member.

7. A wheeled luggage system, comprising:

a) a frame carrying a wheel and including a handle, said frame including a salient tongue and, spaced therefrom by a selected distance, a first releasable fastening member; and b) a externally demountable, releasably attachable carrying case for carrying a portable computer or other delicate instrument, including b1) a substantially planar elongated bottom wall having a front edge opposing a back edge;

b2) front and back walls extending upwardly from said front and back edges of said bottom wall;

b3) an elongated top wall having a front edge connected to said front wall and a back edge connected to said back wall;

b4) a pair of side walls extending between said front and back walls and between said bottom and top walls;

b5) a receiving aperture disposed exteriorly of said back wall near said back edge of said bottom wall, said receiving aperture including an open ended box positioned a selected distance from said top wall and dimensioned to receive said frame salient tongue;

b6) said top wall carrying a second releasable fastening member proximate said back edge of said top wall and positioned to be fastenable with said frame first fastening member when said frame salient tongue is received within said receiving aperture; and b7) said walls defining an enclosed volume sized to receive the portable computer or other delicate instrument and including a shock-absorbing member.

8. A wheeled luggage system, comprising:

a) a frame carrying a wheel and including a handle said frame including a salient tongue and, spaced therefrom by a selected distance, a first releasable fastening member, said frame comprising a wheeled luggage case; and b) a externally demountable, releasably attachable carrying case for carrying a portable computer or other delicate instrument, including b1) a substantially planar elongated bottom wall having a front edge opposing a back edge;

b2) front and back walls extending upwardly from said front and back edges of said bottom wall;

b3) an elongated top wall having a front edge opposing a back edge juxtaposed with said back wall;

b4) said back wall carrying a receiving aperture positioned a selected distance from said top wall and dimensioned to receive said frame salient tongue;

b5) said top wall carrying a second releasable fastening member proximate said back edge and positioned to be fastenable with said frame first fastening member when said frame salient tongue is received within said receiving aperture; and b6) said walls defining an enclosed volume sized to receive the portable computer or other delicate instrument and including a shock-absorbing member.

9. A wheeled luggage system, comprising:

a) a frame carrying a wheel and including a handle, said frame including a salient tongue and, spaced therefrom by a selected distance, a first releasable fastening member; and b) an externally demountable, releasably attachable carrying case for carrying a portable computer or other delicate instrument, including b1) a substantially planar elongated bottom wall having a front edge opposing a back edge;

b2) front and back walls extending upwardly from said front and back edges of said bottom wall;

b3) an elongated top wall having a front edge opposing a back edge juxtaposed with said back wall;

b4) a back panel disposed exteriorly over said back wall and having an upper edge joined to said back wall and a lower edge spaced from said back wall to define a receiving aperture between said back wall and said lower edge of said back panel, said receiving aperture being positioned a selected distance from said top wall and being dimensioned to receive said frame salient tongue;

b5) said top wall carrying a second releasable fastening member proximate said back edge and positioned to be fastenable with said frame first fastening member when said frame salient tongue is received within said receiving aperture; and b6) said walls defining an enclosed volume sized to receive the portable computer or other delicate instrument and including a shock-absorbing member.

10. A wheeled luggage system, comprising:

a) a frame carrying a wheel and including a handle, said frame including a salient tongue and, spaced therefrom by a selected distance, a first releasable fastening member, said frame comprising a garment bag; and b) an externally demountable, releasably attachable carrying case for carrying a portable computer or other delicate instrument, including b1) a substantially planar elongated bottom wall having a front edge opposing a back edge;

b2) front and back walls extending upwardly from said front and back edges of said bottom wall;

b3) an elongated top wall having a front edge opposing a back edge juxtaposed with said back wall;

b4) said back wall carrying a receiving aperture positioned a selected distance from said top wall and dimensioned to receive said frame salient tongue;

b5) said top wall carrying a second releasable fastening member proximate said back edge and positioned to be fastenable with said frame first fastening member when said frame salient tongue is received within said receiving aperture; and b6) said walls defining an enclosed volume sized to receive the portable computer or other delicate instrument and including a shock-absorbing member.

11. A wheeled luggage system, comprising:

a) a frame carrying a wheel and including handle, said frame including a salient tongue and, spaced therefrom by a selected distance, a first releasable fastening member, said frame handle being retractable; and b) an externally demountable, releasably attachable carrying case for carrying a portable computer or other delicate instrument, including b1) a substantially planar elongated bottom wall having a front edge opposing a back edge;

b2) front and back walls extending upwardly from said front and back edges of said bottom wall;

b3) an elongated top wall having a front edge opposing a back edge juxtaposed with said back wall;

b4) said back wall carrying a receiving aperture positioned a selected distance from said top wall and dimensioned to receive said frame salient tongue;

b5) said top wall carrying a second releasable fastening member proximate said back edge and positioned to be fastenable with said frame first fastening member when said frame salient tongue is received within said receiving aperture; and b6) said walls defining an enclosed volume sized to receive the portable computer or other delicate instrument and including a shock-absorbing member.

12. A modular, wheeled luggage case, comprising:

a) a flight bag, including:

a1) a substantially planar elongated bottom wall having a front edge opposing a back edge, said bottom walls carrying a pair of wheels;

a2) front and back walls extending upwardly from said front and back edges of said bottom wall, defining the flight bag exterior;

a3) an elongated top wall having a front edge opposing a back edge juxtaposed with said back wall;

a4) said back wall carrying a retractable handle;

a5) said top wall carrying a first releasable fastening member proximate said front edge;

a6) said front wall having an upper surface disposed between said bottom wall and said top wall, said upper surface being parallel to said bottom wall; and a7) a salient tongue projecting upwardly from said upper surface and positioned a selected distance from said first releasable fastening member; and b) an externally demountable, releasably attachable auxiliary luggage case, including b1) a receiving aperture defined between a back wall and an exterior back panel of said auxiliary luggage case, said receiving aperture being dimensioned to receive said flight bag salient tongue when a bottom wall of said auxiliary luggage case is disposed upon said upper surface of said front wall of said flight bag;

b2) said auxiliary luggage case carrying a second releasable fastening member positioned to be fastenable with said flight bag first releasable fastening member when said flight bag salient tongue is received within said auxiliary case receiving aperture.

13. The modular wheeled luggage case of claim 12, wherein said flight bag is dimensioned to fit within an airline overhead compartment.

14. A modular, wheeled luggage case, comprising:

a) a flight bag, including:

a1) a substantially planar elongated bottom wall having a front edge opposing a back edge, said bottom walls carrying a pair of wheels;

a2) front and back walls extending upwardly from said front and back edges of said bottom wall, defining the flight bag exterior;

a3) an elongated top wall having a front edge opposing a back edge juxtaposed with said back wall;

a4) said back wall carrying a retractable handle;

a5) said top wall carrying a first releasable fastening member proximate said front edge; and a6) said flight bag exterior carrying a salient tongue positioned a selected distance from said first releasable fastening member; and b) an externally demountable, releasably attachable auxiliary luggage case, including:

b1) a receiving aperture dimensioned to receive said flight bag salient tongue;

b2) said auxiliary luggage case carrying a second releasable fastening member positioned to be fastenable with said flight bag first releasable fastening member when said flight bag salient tongue is received within said auxiliary case receiving aperture, said first and second releasable fastening members comprising a combination lock.

15. The modular wheeled luggage case of claim 14, wherein said second releasable fastening member includes a button operated latch.

16. A modular, wheeled luggage case, comprising:

a) a wheeled luggage case, including:

a1) a substantially planar elongated bottom wall having a front edge opposing a back edge, said bottom wall carrying a wheel;

a2) front and back walls extending upwardly from said front and back edges of said bottom wall, defining the case exterior;

a3) an elongated top wall having a front edge opposing a back edge juxtaposed with said back side wall and carrying a first handle;

a4) said back wall carrying a retractable hand grip;

a5) said top wall carrying a first releasable fastening member proximate said front edge; and a6) said exterior carrying a salient tongue positioned a selected distance from said first releasable fastening member; and b) a externally demountable, releasably attachable case, including b1) a substantially planar elongated bottom wall having a front edge opposing a back edge;

b2) front and back side walls extending upwardly from said front and back edges of said bottom wall;

b3) an elongated top wall having a front edge opposing a back edge juxtaposed with said back side wall;

b4) said top wall carrying a second handle;

b5) said back wall carrying a receiving aperture positioned a selected distance from said top wall and dimensioned to receive said salient tongue;

b6) said top wall carrying a second releasable fastening member proximate said back edge and between said first handle and said handle, said second releasable fastening member positioned to be fastenable with said first fastening member when said salient tongue is received within said receiving aperture.

17. The modular, wheeled luggage case of claim 16, wherein said first and second releasable fastening members comprise a combination lock.

18. The modular wheeled luggage case of claim 16, wherein said second releasable fastening member includes a button-operated latch.

* * * * *